US006146500A

United States Patent [19]

Hada et al.

[11] Patent Number: 6,146,500

[45] Date of Patent: Nov. 14, 2000

[54] SUCTION BREAST ROLL FORMER AND METHOD, WITH FLEXIBLE HEADBOX ROOF

[75] Inventors: Frank Stephen Hada; Keith Douglas Glass, both of Appleton, Wis.; Ronald Frederick Gropp, St. Catharines, Canada

[73] Assignee: Kimberly-Clark Worldwide, Inc., Neenah, Wis.

[21] Appl. No.: 09/305,957

[22] Filed: May 6, 1999

Related U.S. Application Data

[60] Provisional application No. 60/089,829, Jun. 19, 1998.

[51] Int. Cl.[7] ..... D21F 1/04

[52] U.S. Cl. ..... 162/212; 162/216; 162/217; 162/315; 162/317; 162/347

[58] Field of Search ..... 162/212, 217, 162/216, 199, 272, 315, 317, 318, 319, 336, 347

[56] References Cited

U.S. PATENT DOCUMENTS

| | | | |
|---|---|---|---|
| Re. 28,269 | 12/1974 | Hill et al. | 162/343 |
| 2,418,600 | 4/1947 | Ostertag et al. | 92/44 |
| 2,832,268 | 4/1958 | Boone et al. | 92/44 |
| 3,072,180 | 1/1963 | Jodrey | 162/319 |
| 3,079,990 | 3/1963 | Taylor et al. | 162/350 |
| 3,645,843 | 2/1972 | Schmaeng | 162/347 |
| 3,734,821 | 5/1973 | Curtis | 162/317 |
| 3,802,960 | 4/1974 | Spengos et al. | 162/216 |
| 3,839,149 | 10/1974 | Justus et al. | 162/317 |
| 3,843,470 | 10/1974 | Betley et al. | 162/343 |
| 3,853,694 | 12/1974 | Parker | 162/216 |
| 3,888,729 | 6/1975 | Parker | 162/343 |
| 3,902,961 | 9/1975 | Roerig et al. | 162/216 |
| 3,923,593 | 12/1975 | Verseput | 162/301 |
| 4,024,016 | 5/1977 | Gordon et al. | 162/214 |
| 4,050,499 | 9/1977 | Luey et al. | 162/317 |
| 4,125,429 | 11/1978 | Hergert et al. | 162/123 |
| 4,128,455 | 12/1978 | Justus | 162/216 |
| 4,133,713 | 1/1979 | Chuang | 162/216 |

(List continued on next page.)

OTHER PUBLICATIONS

Lund, A.M., "Hydraulics and Paper Machine Sheet Formation," *Paper Trade Journal*, vol. 99, Tappi Section, Aug. 9, 1934, pp. 57–60.

Lund, A.M., "The Sheet Formation on a Fourdrinier Wire," *Technical Association Papers*, Series XIX, No. 1, 1936, pp. 443–446.

*Primary Examiner*—Karen M. Hastings

*Attorney, Agent, or Firm*—Thomas J. Connelly; Patricia A. Charlier

[57] ABSTRACT

A suction breast roll former has a support surface with a plurality of apertures formed therein that are operatively connected to a vacuum source. A headbox has a flexible roof extending downstream from a slice opening and disposed adjacent to a support surface of the suction breast roll. The headbox permits the flexible roof to bend over a range of movement relative to the support surface to match the shape of a drainage curve suiting current operating conditions. A method of forming a paper web includes the steps of supplying an aqueous suspension of papermaking fibers to a forming zone created between the suction breast roll and the headbox. The headbox includes a slice body and an apron that define a slice opening therebetween and also has a flexible roof extending from the slice opening and spaced from the support surface to define a forming zone therebetween. A forming fabric is passed through the forming zone to receive the aqueous suspension of papermaking fibers. The flexible roof is permitted to bend over a range of movement relative to the support surface to match the shape of a drainage curve. A restraining member is spaced from the flexible roof and positioned to limit the range of movement of the flexible roof.

29 Claims, 1 Drawing Sheet

U.S. PATENT DOCUMENTS

| | | | |
|---|---|---|---|
| 4,280,870 | 7/1981 | Bubik et al. | 162/336 |
| 4,345,970 | 8/1982 | Radvan et al. | 162/123 |
| 4,361,467 | 11/1982 | Bubik et al. | 162/336 |
| 4,565,603 | 1/1986 | Reiner et al. | 162/123 |
| 4,675,078 | 6/1987 | Reiner | 162/344 |
| 4,692,213 | 9/1987 | Dove | 162/259 |
| 4,824,524 | 4/1989 | Hildebrand | 162/343 |
| 4,897,158 | 1/1990 | Weisshuhn et al. | 162/259 |
| 4,980,026 | 12/1990 | Kade | 162/336 |
| 5,034,098 | 7/1991 | Hergert | 162/203 |
| 5,074,965 | 12/1991 | Keskiivari et al. | 162/216 |
| 5,082,530 | 1/1992 | Keskiivari et al. | 162/216 |
| 5,110,416 | 5/1992 | Linsuri et al. | 162/343 |
| 5,129,988 | 7/1992 | Farrington, Jr. | 162/123 |
| 5,133,836 | 7/1992 | Allen | 162/343 |
| 5,298,125 | 3/1994 | Fabbris | 162/336 |
| 5,348,620 | 9/1994 | Hermans et al. | 162/9 |
| 5,501,768 | 3/1996 | Hermans et al. | 162/9 |
| 5,607,551 | 3/1997 | Farrington, Jr. et al. | 162/109 |
| 5,656,132 | 8/1997 | Farrington, Jr. et al. | 162/117 |
| 5,667,636 | 9/1997 | Engel et al. | 162/117 |

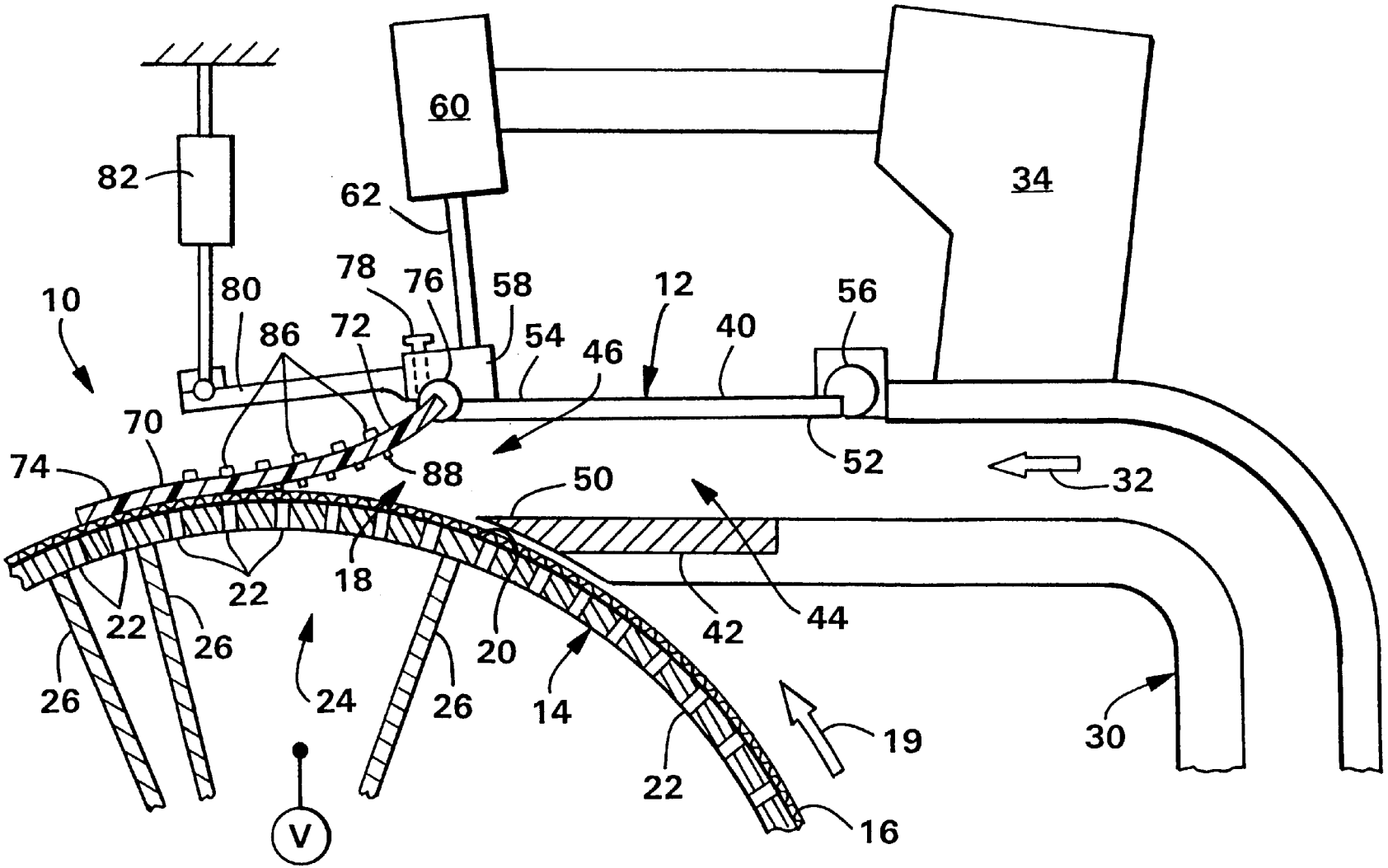
34
32
30
56
52
19
16
44
40
42
12
22
46
50
14
54
58
20
60
76
88
26
62
78
72
18
24
V
86
80
22
26
82
70
22
10
74
26

SUCTION BREAST ROLL FORMER AND METHOD, WITH FLEXIBLE HEADBOX ROOF

This application claims priority from U.S. Provisional Application Ser. No. 60/089,829 filed on Jun. 19, 1998.

FIELD OF THE INVENTION

The present invention relates generally to paper making equipment. More particularly, the invention concerns a suction breast former and a method for forming paper using a suction breast former.

BACKGROUND OF THE INVENTION

Paper webs may be manufactured using a variety of devices, such as suction breast roll formers, twin wire formers, crescent roll formers, or the like. While the aim of paper forming equipment is generally to produce a uniform sheet in both the machine and cross-machine directions, each type of former has particular advantages and disadvantages.

The trend in tissue manufacturing is to produce a sheet with a machine direction (MD) strength to cross-machine direction (CD) strength (MD/CD ratio) that is close to 1.0 to make the most efficient use of fibers to generate strength in the sheet. This is particularly necessary in products that are used by the consumer in various orientations where the overall strength of the sheet becomes the weaker of the MD strength or CD strength.

One disadvantage associated with suction breast roll formers is a high degree of variability in formation depending on the location and operating parameters of the headbox. While suction breast roll formers are generally good at operating at one set of conditions, less than optimal operating conditions produce less than optimal sheet formation. Typical defects in a tissue sheet produced with a suction breast roll former are intermittent machine direction streaks randomly oriented on the surface of the sheet. Sheet defects of this type tend to raise the MD/CD ratio of the sheet.

There is more demand in the competitive tissue market to have tissue machines that are able to make a variety of products on the same machine to make best use of the equipment available. The ability of tissue machines to operate over a wider range of process conditions is becoming more important.

Therefore, what is lacking and needed in the art is an improved suction breast roll former which maintains consistent web formation over a wider range of operating conditions than is presently achievable. What is also lacking and needed is an improved suction breast roll former that can readily be constructed as a retrofit of current suction breast roll formers.

SUMMARY OF THE INVENTION

It has now been discovered that consistent web formation over a wider range of operating conditions can be achieved using a suction breast roll former according to the present invention. Hence, one embodiment of the invention concerns a suction breast roll former including a breast roll and a headbox. The breast roll has a support surface defining apertures therein that are operatively connected to a vacuum source. The headbox is positioned in close proximity to the suction breast roll and is adapted to supply an aqueous suspension of papermaking fibers. The headbox includes a slice body and an apron that together define a slice opening of the headbox. The headbox also includes a flexible roof extending from the slice opening and spaced from the support surface of the breast roll to define therebetween a forming zone of the suction breast roll former. This headbox is adapted to permit the flexible roof to bend over a range of movement, relative to the support surface to match the shape of the drainage curve.

The flexible roof is believed to extend the range of operating conditions over which the suction breast roll former can produce a well-formed sheet. It is hypothesized that the shape of the flexible roof will conform to changes in pressure in the forming zone that result in changes in velocity of the aqueous flow in the forming zone. As a result, the flexible roof will automatically adjust the forming zone shape and length to compensate for changes in operating conditions.

Because the flexibility of the flexible roof does not permit it to support a positive pressure from the fluid, the breast roll is provided with one or more vacuum boxes underneath the support surface to provide a controlled amount of vacuum in the forming zone. The vacuum is adjusted to a point where the position of the flexible roof is stable and in an optimum location. The breast roll includes apertures, such as holes, slots or other open areas, to hold the water away from the wet web until it can be thrown off into a save all, for recycling process water. The breast roll is operatively connected to one or more vacuum sources so that vacuum is supplied into the apertures, and correspondingly to the forming zone. In particular embodiments, the vacuum box includes section dividers to divide the vacuum box into multiple sections. For example, a first vacuum section provides vacuum for forming the sheet and a second vacuum section is used to retain water within the breast roll. Suction breast rolls suitable for use with the present invention are available from papermaking equipment suppliers such as Valmet Corporation, Beloit Corporation or Voith Corporation.

In the present suction breast roll former, the flexible roof is used in conjunction with a rigid support surface of the suction breast roll. As a result, current suction breast roll formers can be relatively easily and inexpensively retrofitted with the present invention. Moreover, the flexible roof can be easily adapted to use with the current mounting of the slice body. Thus, one aspect of the invention relates to a method of modifying an existing suction breast roll former. The existing suction breast roll former includes a breast roll and a headbox positioned in close proximity to the breast roll. The breast roll has a support surface defining apertures therein that are operatively connected to a vacuum source, and the headbox is adapted to supply an aqueous suspension of papermaking fibers. The headbox includes a slice body, an apron that with the slice body defines therebetween a slice opening, and a rigid roof extending from the slice opening and spaced from the support surface to define a forming zone therebetween. The rigid roof is set to a fixed clearance relative to the support surface. The method of modifying the existing suction breast roll former comprises the step of replacing the rigid roof with a flexible roof. The flexible roof extends from the slice opening and is spaced from the support surface to define a forming zone therebetween, and is adapted to bend over a range of movement relative to the support surface to match the shape of the drainage curve.

In the illustrated embodiment, the flexible roof has a proximal edge fixedly attached to a modified version of the slice body and a distal edge in close proximity to the suction breast roll support surface. The distal edge or the trailing portion of the flexible roof desirably rides on the wet web as the web exits the forming zone. Alternatively, the distal edge or the trailing portion of the flexible roof may be spaced from the forming fabric, such as from about 0.8 to about 1.25 millimeters.

The length of the flexible roof, measured between the proximal and distal edges, may be either fixed or adjustable. For a roof of fixed length, the trailing section of the roof after the stock has been dewatered may ride on the surface of the sheet, depending on the length of the forming zone required for that particular set of forming conditions. The leading section of the roof will be more resistant to bending and can be rotated to deflect the flow into the breast roll to control the amount of initial drainage and reduce the amount of hydraulic force on the remainder of the roof.

The headbox is desirably adapted to permit the flexible roof to bend, for example relative to the position of the proximal edge. The roof is desirably flexible in the machine direction, so that the roof can bend in response to temporary changes in the pressure caused by the aqueous suspension of papermaking fibers, as might occur during start-up conditions, and more desirably to conform to the necessary shape required in the forming zone to provide improved formation of the sheet. Desirably, the flexible roof has infinite flexibility in the machine direction, reduced only by the need to have materials of adequate durability and strength to operate in a commercial environment under the loads present. Suitable materials for forming the flexible roof include LEXAN (Polycarbonate, General Electric, Pittsfield, Massachusetts), glass or carbon-fiber reinforced epoxy resins, other polycarbonate materials, fiberglass or other composites, stainless steel or the like, where machining or fiber orientation can achieve the correct flexibility. Fiber reinforced resins may be built to preferentially bend in the machine direction, while maintaining stiffness in the cross-machine direction.

Cross-machine direction flexibility of the flexible roof is generally undesirable, and thus the flexible roof may include a plurality of cross-machine direction stiffening elements. These stiffening elements, which are desirably disposed on the surface of the flexible roof facing away from the forming zone, may be formed of stainless steel, carbon fiber, fiberglass or other composites, plastic compounds or the like. An alternative method is to produce a composite where the stiffness in the cross-machine direction is significantly higher than the stiffness in the machine direction.

To improve web formation by creating turbulence within the suspension of papermaking fibers, the flexible roof may include turbulence generating features disposed on a surface of the flexible roof facing the forming zone. The turbulence generating features may include, for example, a plurality of projections extending outward from the inner surface of the flexible roof that are designed to provide micro-turbulence to the fluid flow near the roof surface, but without disturbing the sheet.

The wet web is formed on a forming fabric that travels through the forming zone between the suction breast roll and the roof. The forming fabric is sandwiched between the support surface and a distal edge of the flexible roof, with the forming fabric and the aqueous suspension generally traveling at the same speed. The term "forming fabric" refers to an endless mesh belt adapted to drain water away from the papermaking fibers and provide support as the web is being formed. Suitable forming fabrics comprise synthetic fabrics and are available from fabric suppliers such as Lindsay Wire and Albany International.

It may be desirable to control the amount of bending of the flexible roof during transient conditions, such as start-up. In particular, a restraining member may be used to restrict large-scale bending of the flexible member while allowing unrestrained bending over a more limited range. Hence, another embodiment of the invention concerns a suction breast roll headbox that is adapted to supply an aqueous suspension of papermaking fibers. The headbox includes a slice body and an apron that define therebetween a slice opening. The headbox includes a flexible roof that extends from the slice opening, and the headbox is adapted to permit the flexible roof to bend over a limited range of movement to match the shape of the drainage curve. The headbox also includes a restraining member spaced from the flexible roof but positioned to limit the range of movement of the flexible roof.

Another aspect of the invention concerns a method of forming a paper web. In one embodiment, the method includes the steps of: supplying an aqueous suspension of papermaking fibers to a forming zone created between a breast roll and a headbox, the breast roll having a support surface defining apertures therein that are operatively connected to a vacuum source, the headbox including a slice body and an apron that define therebetween a slice opening, the headbox further including a flexible roof extending from the slice opening and spaced from the support surface to define the forming zone therebetween; passing a forming fabric through the forming zone to receive the papermaking fibers; and permitting the flexible roof to bend over a range of movement relative to the support surface to match the shape of the drainage curve.

In particular embodiments, the method also includes the step of controlling the velocity of the aqueous suspension and the level of vacuum to achieve removal of water from the forming zone without generating upward pressure on the flexible roof. The aqueous suspension that is under the flexible roof is desirably under a slight vacuum and thus negative pressure with respect to atmospheric pressure. The apparent negative pressure will drain water from the sheet through the fabric. The fluid will drain more slowly as the sheet builds on the fabric and resistance is increased. The absence of fluid and the negative pressure defines the shape of the flexible roof and ensures that there is little difference in the machine direction velocity. In general, from an engineering standpoint, it is desirable to attempt to approximate the curve that would be expected under pressure, when it was not under pressure. This will ensure the lowest possible stresses in the roof.

There are a number of variables that will increase the length and/or time for the formation to take place under the flexible roof. These include basis weight, speed, furnish, and consistency. The drainage of free water from the aqueous suspension should be completed before reaching the distal edge of the flexible lip. To move the dry line upstream of the distal edge and thus achieve complete drainage of free water, the operator can decrease the flow rate of the aqueous suspension, increase the vacuum, or increase the angle of the jet tangent to the breast roll.

The operating parameters of the suction breast roll and headbox such as the throat opening, vacuum levels, and headbox orientation and other operating parameters such as the fan pump speed can be adjusted as will be recognized by those skilled in the art in order to achieve the desired sheet properties. The fiber type, fiber consistency, and other factors will need to be taken into consideration, but by the nature of the invention, are less critical to operation with improved formation.

Many fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or crosslinked fibers) or synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. Mixtures of any subset of the above mentioned or related fiber classes may be used.

The fibers can be prepared in a multiplicity of ways known to be advantageous in the art. Useful methods of preparing fibers include dispersion to impart curl and improved drying properties, such as disclosed in U.S. Pat. Nos. 5,348,620 issued Sep. 20, 1994 and 5,501,768 issued Mar. 26, 1996, both to M.A. Hermans et al. and U.S. Pat. No. 5,656,132 issued Aug. 12, 1997 to Farrington, Jr. et al.; which are incorporated herein by reference.

Once formed, the paper web can be processed using a wide variety of papermaking operations. For example, the paper web may be formed into an uncreped throughdried tissue as disclosed in U.S. Pat. No. 5,667,636 issued Sep. 16, 1997 to S.A. Engel et al.; and U.S. Pat. No. 5,607,551 issued Mar. 4, 1997 to T.E. Farrington, Jr. et al.; which are incorporated herein by reference. The term "paper" is used herein to broadly include writing, printing, wrapping, sanitary, and industrial papers, newsprint, linerboard, tissue, napkins, wipers, towels, or the like.

A single headbox or a plurality of headboxes may be used. The headbox or headboxes may be stratified to permit production of a multilayered structure from a single headbox jet in the formation of a web. In particular, the web may be produced with a stratified or layered headbox to preferentially deposit shorter fibers on one side of the web for improved softness, with relatively longer fibers on the other side of the web or in an interior layer of a web having three or more layers. Multiple embryonic webs from multiple headboxes may be couched or mechanically or chemically joined in the moist state to create a single web having multiple layers.

Numerous features and advantages of the present invention will appear from the following description. In the description, reference is made to the accompanying drawing which illustrates preferred embodiments of the invention. Such embodiments do not represent the full scope of the invention. Reference should therefore be made to the claims herein for interpreting the full scope of the invention.

BRIEF DESCRIPTION OF THE DRAWING

The Figure depicts a suction breast roll former for making a paper web from an aqueous suspension of papermaking fibers.

DETAILED DESCRIPTION OF THE PREFERRED EMBODIMENT

The invention will now be described in greater detail with reference to the single Figure, which depicts a simplified cross-sectional schematic view of a suction breast roll former according to the present invention. Conventional papermaking apparatuses and operations (not shown) can be used with respect to the stock preparation, forming fabrics, web transfers, creping, drying and the like.

The Figure depicts a suction breast roll former 10 for making a paper web from an aqueous suspension of papermaking fibers. The suction breast roll former 10 includes a papermaking headbox 12 placed in operable relation to a suction breast roll 14. The headbox 12 deposits the aqueous suspension of papermaking fibers onto the surface of a forming fabric 16 in a forming zone 18 of the suction breast roll former 10. The forming fabric 16 forms an endless loop traveling between the headbox 12 and the breast roll 14 and around the breast roll 14 in the direction of arrow 19. The forming process allows partial dewatering of a newly-formed paper web, for example to a consistency of about 10 percent.

The suction breast roll 14 includes a support surface 20 that defines a plurality of apertures 22. The apertures 22 are open to one or more vacuum boxes 24 located within the roll 14 in fixed radial locations about the circumference of the roll and operatively connected to a vacuum source V. The vacuum box 24 provides a controlled amount of vacuum in the forming zone. The illustrated vacuum box 24 includes section dividers 26 that divide the vacuum box 24 into multiple sections.

The headbox 12 receives a suspension of papermaking fibers through a flow spreader 30 operatively connected to a conventional stock preparation source (not shown). The papermaking fibers travel in the direction of arrow 32. The flow spreader 30 is mounted on a fixed frame structure 34.

The headbox also includes a slice body 40 and an apron 42 that define therebetween a throat 44 and a slice opening 46. The apron 42 is mounted on the flow spreader 30, and the headbox 12 is positioned so that a downstream end 50 of the apron is positioned in close proximity to the support surface 20 of the suction breast roll 14.

The slice body 40 has an upstream end 52 and an opposite downstream end 54. The upstream end 52 is pivotally mounted to the flow spreader 30 using a rotating joint 56. The downstream end 54 is attached to a mounting bar 58.

A slice adjustment mechanism 60 is linked by an arm 62 to the mounting bar 58 and thus indirectly to the downstream end 54 of the slice body 40. The slice adjustment mechanism 60 is adapted to raise and lower the downstream end of the slice body 40. For purposes of the present description, the slice opening 46 is formed between the downstream end 50 of the apron 42 and the downstream end 54 of the slice body. Operation of the slice adjustment mechanism 60 will change the taper of the throat 44 and the size of the slice opening 46.

The headbox 12 also includes a flexible roof 70 having a proximal edge 72 and an opposite distal edge 74. The flexible roof 70 is desirably pivotally mounted along the proximal edge 72 to the mounting bar 58 using a rotating joint 76. The flexible roof 70 is thus indirectly mounted to the slice body 40 and extends downstream from both the slice body 40 and the slice opening 46. A fastener or other suitable means 78 may be employed to lock rotation of the flexible roof 70 in the rotating joint 76.

The flexible roof 70 may be straight or somewhat curved, with the distal edge 74 in close proximity to the support surface 20. In general, the flexible lip 70 will take the shape required of the process at the current operation conditions. More particularly, the shape of the flexible roof 70 should be the exact shape of the drainage curve. There will be a large initial drainage, which can be controlled by the angle that the jet makes with the forming fabric 16 and the initial, unstressed angle that the flexible roof 70 makes with the curved breast roll surface 20. For the most part, the flexible roof 70 will take a shape that is convex facing the forming fabric 16. The rate of change of convexity of the flexible roof 70 will decrease as the drainage takes place. When the drainage is completed, there will be a point of inflection in the shape, and the flexible roof 70 will be concave to the distal end 74 of the flexible roof 70.

The forming zone 18 is located between the flexible roof 70 and the support surface 20. Either the distal edge 74 of the flexible roof 70 or the trailing region of the flexible roof 70 near the distal edge 74 may ride on the wet web as it is formed. In this case, the forming fabric 16 and the sheet will be sandwiched between the support surface 20 and the flexible roof 70.

The flexible roof 70 is free to bend away from the support surface 20, for example about an axis through the proximal edge 72 or rotating joint 76. Under normal conditions, the free water in the jet will be completely removed prior to the distal end 74 of the flexible roof 70, and should be removed several centimeters ahead of the distal end. Consequently, there will be zero clearance between the roof tip and the forming fabric 16, resulting in improved formation. The expected contact between the flexible roof and the formed sheet operates to seal the vacuum box 24. If a relatively large particle is formed into the sheet, the flexible lip will beneficially bend upward locally and allow the particle that would have normally damaged the forming fabric 16 to pass through.

Optionally, a restraining member 80 may be used to limit the amount of bending of the flexible roof 70. One end of the illustrated restraining member 80 is attached to the mounting bar 58, and the other end is adjustably mounted using a gap adjustment mechanism 82. Significantly, the restraining member 80 should not impede the range of bending that would result due to normal variations of the papermaking process. Under preferred operating conditions, however, the wet web is formed at negative pressure and there is substantially no upward force on the flexible roof 70. Correspondingly, during routine operation, the restraining member 80 is not in contact with the flexible roof 70 and exerts no downward pressure on the flexible roof 70.

In particular embodiments, the flexible roof 70 may include a plurality of stiffening elements 86 extending across the flexible roof 70 in the cross-machine direction. Further, the flexible roof 70 may include turbulence generating features 88 disposed on the surface of the flexible roof facing the forming zone 18. In the illustrated embodiment, for example, the turbulence generating features 88 include fastener heads joined to the stiffening elements 86. The size, shape, spacing and number of turbulence generating features 88 will depend on the range of operating conditions required for the particular application of this invention.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Further, various alternative process and equipment arrangements may be employed, particularly with respect to the stock preparation and forming fabrics. Therefore, the invention should not be limited by the specific embodiments described, but only by the claims and all equivalents thereto.

We claim:

1. A suction breast roll former comprising:

a) a suction breast roll having a support surface with apertures formed therein that are operatively connected to a vacuum source;

b) a headbox positioned in a close proximity to said suction breast roll and adapted to supply an aqueous suspension of papermaking fibers to said support surface, said headbox including a slice body and an apron that define a slice opening therebetween, said headbox further including a flexible roof extending from said slice opening and spaced from said support surface to define a forming zone therebetween, said headbox structured and arranged to permit said flexible roof to bend over a range of movement relative to said support surface in response to operating conditions; and c) a restraining member spaced from said flexible roof and positioned to limit the range of movement of said flexible roof.

2. The suction breast roll former of claim 1 wherein said support surface is rigid.

3. The suction breast roll former of claim 1 wherein said flexible roof contains a plurality of stiffening elements.

4. The suction breast roll former of claim 3 wherein said stiffening elements are positioned in a cross-machine direction across said flexible roof.

5. The suction breast roll former of claim 3 wherein said stiffening elements are disposed on a surface of said flexible roof facing away from said forming zone.

6. The suction breast roll former of claim 1 wherein said flexible roof has a proximal edge fixedly attached to said slice body and a distal edge in close proximity to said support surface, said headbox adapted to permit said flexible roof to bend about said proximal edge.

7. The suction breast roll former of claim 1 wherein said flexible roof has a flexibility comparable to polycarbonate materials.

8. The suction breast roll former of claim 1 further comprising a forming fabric sandwiched between said support surface and a distal edge of said flexible roof.

9. The suction breast roll former of claim 1 wherein said flexible roof includes turbulence generating feature disposed on a surface thereof which faces said forming zone.

10. A suction breast roll former comprising:

a) a suction breast roll having a support surface; and b) a headbox having a flexible roof extending downstream from a slice opening and disposed adjacent to said support surface, wherein said headbox is structured and arranged to permit said flexible roof to bend freely over a range of movement relative to said support surface, said headbox further including a restraining member spaced from said flexible roof and positioned to limit the range of movement of said flexible roof.

11. The suction breast roll former of claim 10 wherein said support surface is rigid.

12. The suction breast roll former of claim 10 wherein said support surface includes a plurality of apertures formed therein which are operatively connected to a vacuum source.

13. The suction breast roll former of claim 10 wherein said flexible roof contains a plurality of stiffening elements.

14. The suction breast roll former of claim 13 wherein said stiffening elements are positioned in a cross-machine direction across said flexible roof.

15. A suction breast roll former comprising:

a) a suction breast roll having a support surface with apertures therein that are operatively connected to a vacuum source;

b) a headbox positioned in a close proximity to said suction breast roll and adapted to supply an aqueous suspension of papermaking fibers to said support surface, said headbox including a slice body and an apron that define a slice opening therebetween, said headbox further including a flexible roof extending from said slice opening and spaced from said support surface to define a forming zone therebetween, said headbox structured and arranged to permit said flexible roof to bend over a range of movement relative to said support surface to match the shape of a drainage curve; and c) a restraining member spaced from said flexible roof and positioned to limit the range of movement of said flexible roof.

16. The suction breast roll former of claim 15 wherein said flexible roof has a proximal edge fixedly attached to said slice body and a distal edge in close proximity to said support surface, said headbox adapted to permit said flexible roof to bend about said proximal edge.

17. The suction breast roll former of claim 15 wherein said flexible roof contains a plurality of stiffening elements positioned in a cross-machine direction.

18. The suction breast roll former of claim 17 wherein said stiffening elements are disposed on a surface of said flexible roof facing away from said forming zone.

19. The suction breast roll former of claim 15 wherein said flexible roof has a flexibility comparable to polycarbonate materials.

20. The suction breast roll former of claim 15 further comprising a forming fabric sandwiched between said support surface and a distal edge of said flexible roof.

21. The suction breast roll former of claim 15 wherein said flexible roof includes turbulence generating feature disposed on a surface thereof which faces said forming zone.

22. A method of forming a paper web, comprising the steps of:

a) supplying an aqueous suspension of papermaking fibers to a forming zone created between a suction breast roll and a headbox, said suction breast roll having a support surface with apertures formed therein that are operatively connected to a vacuum source, said headbox including a slice body and an apron that define a slice opening therebetween, said headbox further including a flexible roof extending from said slice opening and spaced from said support surface to define a forming zone therebetween;

b) passing a forming fabric through said forming zone to receive said aqueous suspension of papermaking fibers; and c) permitting said flexible roof to bend over a range of movement relative to said support surface to match the shape of a drainage curve, said headbox further including a restraining member spaced from said flexible roof and positioned to limit the range of movement of said flexible roof.

23. The method of claim 22 further comprising controlling the velocity of said aqueous suspension to achieve removal of water from said forming zone without generating upward pressure on said flexible roof.

24. The method of claim 22 further comprising controlling the level of vacuum at said vacuum source to achieve removal of water from said forming zone without generating upward pressure on said flexible roof.

25. The method of claim 22 further comprising controlling the velocity of said aqueous suspension and the level of vacuum to achieve removal of water from said forming zone without generating upward pressure on said flexible roof.

26. A method of modifying an existing suction breast roll former, said existing suction breast roll former comprising a suction breast roll and a headbox positioned in close proximity to said suction breast roll, said suction breast roll having a support surface with apertures formed therein that are operatively connected to a vacuum source, said headbox adapted to supply an aqueous suspension of papermaking fibers to said suction breast roll, said headbox including a slice body, an apron that with said slice body defines a slice opening therebetween, and a rigid roof extending from said slice opening and spaced from said support surface to define a forming zone therebetween, the rigid roof set to a fixed clearance relative to said support surface, said method comprising the steps of:

a) replacing said rigid roof with a flexible roof that extends from said slice opening and is space from said support surface to define a forming zone therebetween, said flexible roof structured and arranged to bend over a range of movement relative to said support surface to match the shape of a drainage curve; and b) adding a restraining member to said headbox wherein said restraining member is spaced from said flexible roof and positioned to limit the range of movement of said flexible roof.

27. The method of claim 26 further comprising controlling the velocity of said aqueous suspension to achieve removal of water from said forming zone without generating upward pressure on said flexible roof.

28. The method of claim 26 further comprising controlling the level of vacuum at said vacuum source to achieve removal of water from said forming zone without generating upward pressure on said flexible roof.

29. The method of claim 26 further comprising controlling the velocity of said aqueous suspension and the level of vacuum to achieve removal of water from said forming zone without generating upward pressure on said flexible roof.

* * * * *